US011352686B2

(12) United States Patent
Engler et al.

(10) Patent No.: US 11,352,686 B2
(45) Date of Patent: Jun. 7, 2022

(54) HIGH-STRENGTH AND EASILY FORMABLE ALMG-STRIP, AND METHOD FOR PRODUCING THE SAME

(71) Applicants: Olaf Engler, Bonn (DE); Henk-Jan Brinkman, Bonn (DE)

(72) Inventors: Olaf Engler, Bonn (DE); Henk-Jan Brinkman, Bonn (DE)

(73) Assignee: Hydro Aluminium Rolled Products GmbH, Grevenbroich (DE)

( * ) Notice: Subject to any disclaimer, the term of this patent is extended or adjusted under 35 U.S.C. 154(b) by 0 days.

(21) Appl. No.: 15/849,387

(22) Filed: Dec. 20, 2017

(65) Prior Publication Data

US 2018/0112297 A1 Apr. 26, 2018

Related U.S. Application Data

(63) Continuation of application No. PCT/EP2016/064530, filed on Jun. 23, 2016.

(30) Foreign Application Priority Data

Jun. 25, 2015 (EP) ..... 15173888

(51) Int. Cl.
*C22F 1/047* (2006.01)
*C22C 21/06* (2006.01)
*C22C 21/08* (2006.01)

(52) U.S. Cl.
CPC ..... *C22F 1/047* (2013.01); *C22C 21/06* (2013.01); *C22C 21/08* (2013.01)

(58) Field of Classification Search
CPC ..... C22C 21/06; C22F 1/047
See application file for complete search history.

(56) References Cited

U.S. PATENT DOCUMENTS

| | | | | |
|---|---|---|---|---|
| 6,939,416 | B2 | 9/2005 | Benedictus et al. | |
| 2015/0159250 | A1 | 6/2015 | Engler et al. | |
| 2015/0159251 | A1* | 6/2015 | Hentschel | C22F 1/047 148/552 |
| 2016/0355915 | A1* | 12/2016 | Kadali | B22D 15/00 |

FOREIGN PATENT DOCUMENTS

| | | | |
|---|---|---|---|
| CA | 2 985 067 | A1 | 12/2016 |
| CN | 102586707 | A | 7/2012 |

(Continued)

OTHER PUBLICATIONS

Davis, J.R. ASM Specialty Handbook, "Aluminum and Aluminum Alloys", 1993, pp. 319-320. (Year: 1993).*

(Continued)

*Primary Examiner* — George Wyszomierski
*Assistant Examiner* — Janell C Morillo
(74) *Attorney, Agent, or Firm* — Reinhart Boerner Van Deuren P.C.

(57) ABSTRACT

Provided is a method for producing an aluminium alloy strip from a non-precipitation-hardenable aluminium alloy having the following alloying constituents in wt %: 3.6%≤Mg≤6%, Si≤0.4%, Fe≤0.5%, Cu≤0.15%, 0.1%≤Mn≤0.4%, Cr≤0.05%, Zn≤0.20%, Ti≤0.20%, with the remainder Al and unavoidable impurities, individually at most 0.05 wt %, in total at most 0.15 wt %. In the method, a rolling ingot is cast. The rolling ingot is homogenised and then hot rolled into a hot strip. Then, the strip is cold rolled before a last intermediate annealing. The intermediate annealing is carried out to produce a recrystallised microstructure. The intermediate-annealed aluminium alloy strip is cold rolled to a final thickness, and the aluminium alloy strip is reverse annealed in the coil to a final thickness.

14 Claims, 2 Drawing Sheets

(56) References Cited

FOREIGN PATENT DOCUMENTS

| | | | | |
|---|---|---|---|---|
| CN | 103924175 | A | 7/2014 | |
| DE | 10 2009 008 282 | A1 | 8/2010 | |
| EP | 0 769 564 | A1 | 4/1997 | |
| JP | 04-246147 | A | 9/1992 | |
| JP | 05-009680 | A | 1/1993 | |
| JP | 06-145926 | A | 5/1994 | |
| JP | 08-053732 | A | 2/1996 | |
| JP | 2013-194286 | A | 9/2013 | |
| JP | 2015-532679 | A | 11/2015 | |
| JP | 2016-504483 | A | 2/2016 | |
| RU | 2 194 787 | C2 | 12/2002 | |
| WO | WO 2008/098743 | A1 | 8/2008 | |
| WO | WO 2014/029853 | A1 | 2/2014 | |
| WO | WO-2014029853 | A1 * | 2/2014 | ..... C22F 1/047 |

OTHER PUBLICATIONS

P.Z. Zhao et al., Development of twin-belt cast AA5XXX series aluminum alloy materials for automotive sheet applications, article, Aluminum Alloys: Fabrication, Characterization and Applications II, Feb. 15, 2009, pp. 11-17, TMS (The Minerals, Metals & Materials Society).

W.C. Liu et al., Comparison of recrystallization and recrystallization of textures in cold-rolled DC and CC AA 5182 aluminum alloys, article, Materials Science and Engineering A358, Oct. 1, 2003, pp. 84-93, Elsevier Science B.V.

* cited by examiner

HIGH-STRENGTH AND EASILY FORMABLE ALMG-STRIP, AND METHOD FOR PRODUCING THE SAME

CROSS-REFERENCE TO RELATED PATENT APPLICATIONS

This patent application is a continuation of PCT/EP2016/064530, filed Jun. 23, 2016, which claims priority to European Application No. 15173888.7, filed Jun. 25, 2015, the entire teachings and disclosure of which are incorporated herein by reference thereto.

FIELD OF INVENTION

The invention relates to a method for producing an aluminium strip or sheet from an aluminium alloy and to an aluminium alloy strip or sheet and its use.

BACKGROUND OF INVENTION

Rolled aluminium alloy sheets play an increasing role in current automotive lightweight construction concepts, as they can have a lower weight compared to equivalent solutions consisting of steel. In highly stressed vehicle components, the strength, for example the yield strength $R_{p0.2}$ and the tensile strength $R_m$, plays a primary role, since the thickness of the respective aluminium sheet for the vehicle component is determined through this and hence the weight of the vehicle component as well. Vehicle components, for example parts of the so-called "Body in White" (BIW components), often require complexly formed geometries, so that good forming behaviour for providing the complex geometries constitutes a further very important requirement for the use of aluminium alloy sheets as vehicle components. Although the corrosion behaviour of aluminium alloy sheets is generally already very good, the intercrystalline corrosion must be taken into account both in the case of the AA6XXX class precipitation-hardenable aluminium alloys and in the case of the AA5XXX class non-precipitation-hardenable alloys, since it can lead to the failure of components.

Up to now, the highly stressed vehicle components have preferably been produced from aluminium sheets consisting of an AA6XXX class precipitation-hardenable Al—Mg—Si alloy. Aluminium alloy sheets of this class are formed in the T4 solution-annealed state and subsequently subjected to an artificial ageing treatment in order to obtain a higher final strength in the T6 state. This complicated production process results in higher production costs, in particular also due to the logistical effort required for processing the sheets in the T4 state and for artificially ageing the sheets to obtain the T6 state. Up to now, components consisting of type AA5XXX non-precipitation-hardenable aluminium alloys were produced by forming soft-annealed aluminium alloy sheets. However, the disadvantage with this is that these sheets only show an increase in strength, in particular an increase in the yield strength $R_{p0.2}$, in the areas of high degrees of deformation. In contrast, the unformed areas remain in a soft state. It follows from this that the lightweight construction potential in the case of vehicle components consisting of economically cost-effectively producible, non-precipitation-hardenable aluminium alloys has not up to now been able to be fully taken advantage of, since the sheet thicknesses of the vehicle components have to be correspondingly chosen on account of the soft areas of the formed parts.

Type AA 5xxx Al—Mg alloys with Mg contents of more than 3 wt %, in particular of more than 4 wt %, are increasingly prone to intercrystalline corrosion if they are exposed to increased temperatures for example. At temperatures of 70° C.-200° C. $\beta$-$Al_5Mg_3$ phases precipitate along the grain boundaries, which are referred to as $\beta$ particles and in the presence of a corrosive medium can be selectively dissolved. This also applies to the components of a motor vehicle, in particular to the components of the so-called "Body in White" of the motor vehicle, which are usually subjected to a cathodic dip coating (CDC) and subsequently dried in a burning-in process. In the case of standard aluminium alloy strips, sensitization with respect to intercrystalline corrosion can already be caused by this burning-in process. Furthermore, for use in the automotive industry the forming operation during production of a component and the subsequent operating load on the component have to be taken into account.

Proneness to intercrystalline corrosion is usually tested in a standard test according to ASTM G67, in which the samples are exposed to a nitric acid and the mass loss of the aluminium sheet is measured. In the present application, with the standard tests according to ASTM G67 corresponding thermal stress on the components in the application case is simulated by a prior sensitization heat treatment at temperatures of 130° C. for 17 h. According to ASTM G67, the mass loss in the case of materials which are not resistant to intercrystalline corrosion is more than 15 mg/cm$^2$.

The international patent application WO 2014/029853 A1 stemming from the applicant discloses the production of a soft-annealed aluminium alloy sheet for a motor vehicle component which is resistant to intercrystalline corrosion. Although, the aluminium alloy sheets disclosed here exhibit a good tensile strength $R_m$ and outstanding values for the uniform elongation $A_g$ with good resistance to intercrystalline corrosion, the values for the yield strength $R_{p0.2}$, which represents a measurement for the resistance of the sheet to plastic deformation, are too low to obtain a significant reduction in the sheet thicknesses and hence a further weight saving in the production of vehicle components. In terms of the present patent application, vehicle components are understood as formed sheets of the inner structure of a motor vehicle, also referred to as components of the "Body in White" (BIW), as well as chassis components and parts of the vehicle body.

The production of a sheet part for highly stressed vehicle components consisting of non-precipitation-hardenable aluminium alloys is known from the German patent application DE 10 2009 008 282 A1. It is proposed to form strain-hardened and reverse annealed aluminium alloy sheets in a hot-forming process at temperatures of up to 250° C. Details on specific aluminium alloy compositions or production processes for aluminium alloy sheets are not known from the named German patent application. In addition, information about specific mechanical properties of a strain-hardened and reverse annealed aluminium alloy strip are not disclosed in the named German patent application.

On this basis, it is therefore the object of the present invention to provide a method for producing an aluminium alloy strip or sheet from a non-precipitation-hardenable aluminium alloy, from which formed parts for vehicle components, in particular BIW components, can be easily produced and further weight savings can be obtained. Furthermore, the present invention is based on the object of proposing an aluminium alloy strip or sheet consisting of a precipitation-hardenable aluminium alloy which in addition to having a high weight saving potential in the motor vehicle can be cost-effectively produced. Finally, advantageous uses of the aluminium alloy strip are also to be proposed.

BRIEF SUMMARY OF THE INVENTION

According to a first teaching of the present invention, the previously mentioned object is achieved by a method for producing an aluminium strip or sheet from an aluminium alloy having the following alloying constituents in wt %:

3.6%≤Mg≤6%,
Si≤0.4%,
Fe≤0.5%,
Cu≤0.15%,
0.1%≤Mn≤0.4%,
Cr≤0.05%,
Zn≤0.20%,
Ti≤0.20%, with the remainder Al and unavoidable impurities, individually at most 0.05 wt %, in total at most 0.15 wt %, wherein the method comprises the following steps:

- casting a rolling ingot consisting of the specified aluminium alloy,
- homogenising the rolling ingot at 480° C. to 550° C. for at least 0.5 h,
- hot rolling the rolling ingot at a temperature of 280° C. to 500° C. into a hot strip.
- cold rolling the aluminium alloy strip after hot rolling with a degree of rolling of 10% to 45% directly before a last intermediate annealing,
- carrying out at least a last intermediate annealing on the cold-rolled aluminium alloy strip at 300° C. to 500° C. in such a way that the cold-rolled aluminium alloy strip has a recrystallised microstructure after the intermediate annealing,
- cold rolling the intermediate-annealed aluminium alloy strip with a degree of rolling of 30% to 60% to a final thickness and
- reverse annealing the aluminium alloy strip in the coil to a final thickness, wherein the metal temperature is 190-250° C. for at least 0.5 h.

In further processing, sheets can then be cut to length from the aluminium alloy strip. The magnesium content of the aluminium alloy to be used according to the invention of 3.6 wt % to 6 wt %, preferably 4.2 wt % to 6 wt %, particularly preferably 4.2 wt % to 5.2 wt %, contributes to the fact that the aluminium alloy with good forming properties at the same time achieves high strength values, in particular yield strength values $R_{p0.2}$ and tensile strength values $R_m$. Unwanted age hardening and precipitation effects of Si are reduced by limiting the Si content to at most 0.4 wt %. The Fe content should be limited to at most 0.5 wt %, so that the properties of the aluminium alloy are not negatively affected. This also applies for the copper content which is to be limited to at most 0.15 wt % Manganese results in an increase in strength and also results in an improvement in the resistance to intercrystalline corrosion. However, the manganese content must be limited, since otherwise the forming properties of the reverse annealed aluminium alloy strips are negatively affected. Furthermore, too high Mn contents during the last intermediate annealing result in average grain diameters of less than 20 μm. For this reason, the Mn content should be 0.1 wt % to 0.4 wt %. Chromium even in minimal amounts already results in the forming properties, for example the uniform elongation $A_g$ or the percentage reduction of area after fracture Z decreasing, so that the forming properties worsen. In addition, Cr also results in small grain sizes after the intermediate annealing. In this respect, the chromium content is to be limited to values of less than 0.05 wt %, preferably to less than 0.01 wt % The same also in principle applies for Zr which is not individually listed here, since it normally has to be added to the alloy. Zinc could have a negative effect on the corrosion resistance of the aluminium alloy strip and is therefore to be limited to 0.2 wt % Titanium is usually added as a grain refiner, for example in the form of Ti boride wire or rods, during continuous casting of the aluminium alloy. However, excessive Ti contents again have a negative effect on the forming properties, so that a limit on the Ti content of at most 0.20 wt % is desired.

By casting and homogenising the rolling ingot at 480° C. to 550° C. for at least 0.5 hours, a rolling ingot which has a very homogenous distribution of the alloying constituents can be provided for the hot rolling. At the end of the hot rolling, a homogenous, recrystallised hot strip is provided by hot rolling in a temperature range of 280° C. to 500° C. Before the last intermediate annealing, the degree of rolling during cold rolling of the aluminium alloy strip is according to the invention 10% to 45%, since the degree of rolling before the last intermediate annealing critically influences the formation of the grain structure during recrystallisation during the intermediate annealing. If the degree of rolling is too high, a relatively fine microstructure with average grain diameters, i.e. an average grain size of less than 20 μm is produced during the recrystallisation during the last intermediate annealing at a temperature of 300° C. to 500° C. The reduced grain diameters, however, have a negative effect on the corrosion behaviour of the aluminium alloy strip. With low degrees of rolling of 10% to 45% during cold rolling before the intermediate annealing, average grain diameters of more than 20 μm are produced with the composition according to the invention during the last intermediate annealing, which positively affect the corrosion resistance of the aluminium alloy strip. The intermediate annealing as such enables a recrystallised microstructure to be provided for the last cold-rolling step which is carried out with a degree of rolling of 30% to 60% to a final thickness. The final degree of rolling, unlike soft-annealed variants, renders it possible to continuously increase the yield strength of the aluminium alloy strip to be produced by strain hardening for the desired application, for example to a yield strength of more than 190 MPa after the subsequent final annealing. The final reverse annealing of the aluminium alloy strip in the coil at metal temperatures of 190° C. to 250° C. for at least 0.5 hours results in an improvement in the forming properties, in particular in the uniform elongation $A_g$ and the percentage reduction of area after fracture Z, through the recovery process in the microstructure of the aluminium alloy strip. The higher yield strength $R_{p0.2}$ compared to the soft state is, however, at least to a large extent maintained. With the production method, an aluminium alloy strip can thereby be provided which, on the one hand, can be easily formed for example into a vehicle component and which, on the other hand, also provides high yield strengths in the unformed areas. The produced aluminium alloy strip is, at the same time, also resistant to intercrystalline corrosion and due to the simple production process is more cost-effective than previously used AA6XXX alloy strips.

If, according to a first embodiment of the method according to the invention, the degree of rolling during cold rolling before the last intermediate annealing is limited to 20% to 30%, larger grain diameters are provided in the aluminium alloy strip after the last intermediate annealing and hence the resistance to intercrystalline corrosion in the reverse annealed aluminium alloy strip is improved.

If, according to a subsequent embodiment of the method, the degree of rolling during cold rolling to a final thickness after the last intermediate annealing is 40% to 60%, the yield strength $R_{p0.2}$ can be set to values above 200 MPa without the forming properties, for example the uniform elongation $A_g$ or the percentage reduction of area after fracture Z, being negatively affected.

As has already been previously explained, the method according to the invention enables aluminium alloy strips and sheets to be provided for forming into vehicle components, for example Body-in-White (BIW) components. According to a further embodiment of the method, if the aluminium alloy strip is cold rolled to a thickness of 0.5 mm to 5.0 mm, preferably to a final thickness of 1.0 mm to 3.0 mm, formed parts can be produced from a non-precipitation-hardenable aluminium alloy for vehicle components, which can realise weight saving potentials in automotive engineering in a cost-effective way.

According to a further embodiment of the method, the temperature during reverse annealing of the aluminium alloy strip is 220° C. to 240° C. By choosing the higher temperature during reverse annealing, through recovery processes the formability of the aluminium alloy strip with an increase in the uniform elongation $A_g$ and in the percentage reduction of area after fracture Z is provided in a process-reliable way. The high reverse annealing temperatures of 220° C. to 240° C. also result in an improved long-term stability of components produced from the aluminium alloy strip according to the invention in the case of any thermal stress in operation.

According to a second teaching of the present invention, the above mentioned object is achieved by a cold-rolled and reverse annealed aluminium alloy strip or sheet, which is preferably produced using the method according to the invention, consisting of an aluminium alloy having the following alloying constituents:

3.6%≤Mg≤6%,
Si≤0.4%,
Fe≤0.5%,
Cu≤0.15%,
0.1%≤Mn≤0.4%,
Cr≤0.05%,
Zn≤0.20%,
Ti≤0.20%, with the remainder Al and unavoidable impurities, individually at most 0.05 wt %, in total at most 0.15 wt %, wherein the aluminium alloy strip has a yield strength $R_{p0.2}$ of more than 190 MPa,
a uniform elongation $A_g$ of at least 14%,
a percentage reduction of area after fracture Z of more than 50%, and
in the corrosion test according to ASTM G67, after a prior sensitization heat treatment for 17 h at 130° C., a mass loss of less than 15 mg/cm$^2$.

It has become apparent that providing an aluminium alloy strip or sheet with the above specified aluminium alloy composition having a yield strength of more than 190 MPa, having a uniform elongation $A_g$ of at least 14% and a percentage reduction of area after fracture Z of more than 50% with, at the same time, resistance in the corrosion test according to ASTM G67 with a mass loss of less than 15 mg/cm$^2$ after a prior sensitization heat treatment for 17 h at 130° C. makes further application possibilities available for non-precipitation-hardenable aluminium alloy strips which up to now were reserved for aluminium alloy strips consisting of precipitation-hardenable materials, in particular consisting of type AA6xxx aluminium alloys. It is expected that with the given aluminium alloy composition, yield strengths $R_{p0.2}$ of more than 190 MPa to 300 MPa with a uniform elongation $A_g$ of 14% to 18% and a percentage reduction of area after fracture Z of more than 50% to 70% with the above mentioned corrosion resistance can be obtained. The exemplary embodiments presented later show aluminium alloy strips or sheets according to the invention with yield strengths $R_{p0.2}$ of more than 190 MPa and up to 270 MPa while retaining good forming behaviour due to a uniform elongation $A_g$ of up to 16.6% and a percentage reduction of area after fracture Z of up to 62% with resistance to intercrystalline corrosion present. According to expectations, the yield strength values behave contrary to the obtained values of the uniform elongation $A_g$ and the percentage reduction of area after fracture Z. These specific aluminium alloy strips thereby make further application possibilities available and in particular the possibility of providing cost-effectively producible aluminium alloy strips and sheets for producing vehicle components, in particular BIW components.

According to a further embodiment of the aluminium alloy strip according to the invention, if the Mg content of the aluminium alloy strip or sheet is 4.2 wt % to 6 wt %, preferably 4.2 wt % to 5.2 wt %, an aluminium alloy strip or sheet can be provided with maximum yield strengths after the last cold rolling.

According to a further embodiment of the aluminium alloy strip according to the invention, if the Mn content is limited to from 0.1 wt % to 0.3 wt %, then, despite the positive effect of manganese on the strength and corrosion resistance of the aluminium alloy strip or sheet, at the same time good forming properties, i.e. high values for the uniform elongation $A_g$ and the percentage reduction of area after fracture Z, can be obtained in a way which is very process reliable. In addition, with these Mn contents average grain diameters of more than 20 μm can be set during the last intermediate annealing in a process-reliable way which positively affect the corrosion resistance of the aluminium alloy strip or sheet.

As has also been previously explained, the chromium content even in very small concentrations negatively affects the properties of the aluminium alloy in relation to the forming behaviour and limits the grain size after the last intermediate annealing, so that, according to a further embodiment of the aluminium alloy strip or sheet, the chromium content is limited to less than 0.01 wt % This similarly also applies for zirconium and scandium which, however, if at all, are only present in traces in the aluminium alloy.

According to a further embodiment, if the aluminium alloy strip or sheet has one or more of the following restrictions on the proportions of the alloying constituents:

Si≤0.2 wt %,
Fe≤0.35 wt % or
Zn≤0.01 wt %, negative effects of the said alloying constituents on the properties of the aluminium alloy strip or sheet can be ruled out.

According to a further embodiment of the aluminium alloy strip or sheet according to the invention, the aluminium alloy strip has one or more of the following properties:

a yield strength $R_{p0.2}$ of more than 200 MPa,
a uniform elongation $A_g$ of at least 15%,
a percentage reduction of area after fracture Z of at least 55% or
in the corrosion test according to ASTM G67, after a prior sensitization heat treatment for 17 h at 130° C., a mass loss of less than 10 mg/cm$^2$.

By setting the specific properties yield strength, uniform elongation, percentage reduction of area after fracture and behaviour in the corrosion test, the aluminium alloy strip can additionally be produced such that it is adapted to the different areas of application. For example, a higher yield strength of more than 200 MPa can enable a reduction in the final thicknesses of the aluminium alloy strip and hence a further reduction in the weight of the formed part produced from it, for example of a vehicle component. The increase in the uniform elongation to at least 15% and the increase in the percentage reduction of area after fracture to at least 55% result in the aluminium alloy strip or sheet according to the invention being able to be used in more complex forming processes and, for example, complexly designed formed parts can be produced with few forming steps. The improvement in the corrosion resistance to intercrystalline corrosion in the corrosion test according to ASTM G67 in turn results in increased reliability of a formed part produced from the aluminium alloy strip against failure due to intercrystalline corrosion.

If, according to a further embodiment, the aluminium alloy strip or sheet has a thickness of 0.5 mm to 5.0 mm, preferably 1.0 mm to 3.0 mm, formed parts can be produced from the aluminium alloy strip which have similar properties as formed parts consisting of AA6XXX type precipitation-hardenable aluminium alloys.

According to this embodiment, the aluminium alloy strip or sheet, particularly in the thickness ranges 1.0 mm to 3.0 mm, renders a considerably increased area of application possible due to the substantially improved yield strengths compared to the previously used, soft-annealed variants.

Finally, the above mentioned object is also achieved by the use of an aluminium alloy strip or sheet according to the invention for producing structural parts or vehicle components, in particular BIW components, of a motor vehicle, since the aluminium alloy strips according to the invention enable formed parts to be produced for the corresponding use which can undergo very high degrees of deformation, but which at the same time provide high yield strengths to reduce the material thickness of the aluminium alloy strip or sheet and nevertheless have very good corrosion behaviour in the corrosion test according to ASTM G67.

BRIEF DESCRIPTION OF THE SEVERAL VIEWS OF THE DRAWING

The invention is to be explained in more detail below by means of exemplary embodiments in conjunction with the figure. The figure shows.

DETAILED DESCRIPTION OF THE INVENTION

Figure 1:
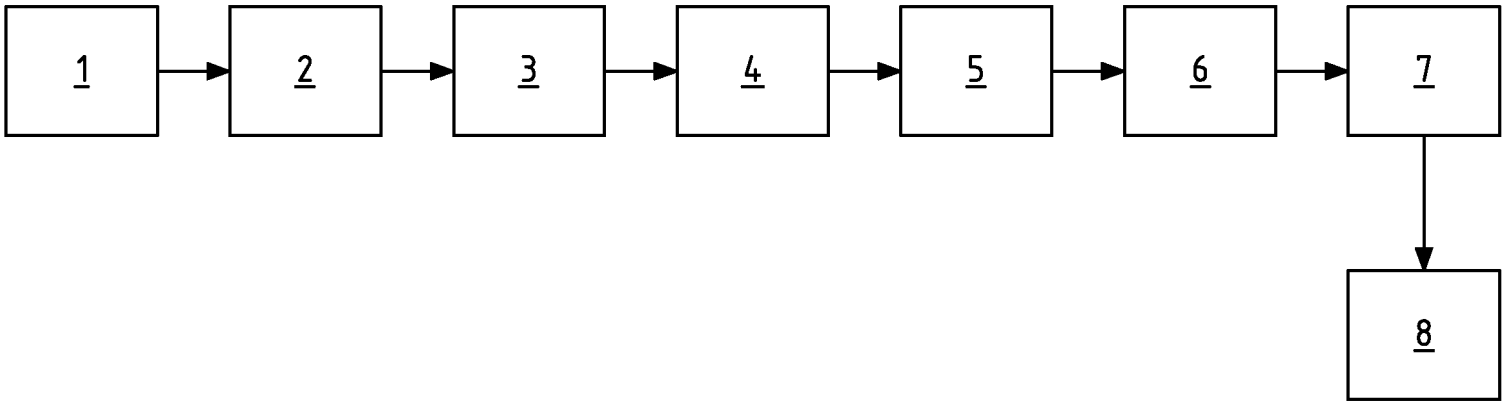
FIG. 1 shows a schematic illustration the method steps of an exemplary embodiment of the method for producing an aluminium alloy strip.

FIG. 1 firstly shows in a schematic illustration the method steps of an exemplary embodiment for producing an aluminium strip based on an aluminium alloy according to the present invention. Firstly, in step 1 a rolling ingot consisting of an aluminium alloy is cast having the following alloy contents:

3.6 wt %≤Mg≤6 wt %,
Si≤0.4 wt %,
Fe≤0.5 wt %,
Cu≤0.15 wt %,
0.1 wt %≤Mn≤0.4 wt %,
Cr≤0.05 wt %,
Zn≤0.20 wt %,
Ti≤0.20 wt %,
with the remainder Al and unavoidable impurities, individually at most 0.05 wt %, in total at most 0.15 wt %

The rolling ingot is homogenised at a temperature of 480° C. to 550° C. for a period of at least 0.5 h according to step 2. Subsequently, in step 3 the rolling ingot is hot rolled at a temperature of 280° C. to 500° C. into a hot strip. Before a last intermediate annealing according to step 5, the aluminium alloy strip is cold rolled with a degree of rolling of 10% to 45% according to step 4. Limiting the degree of rolling to 10% to 45% means that during the subsequent intermediate annealing according to step 5, an average grain size of more than 20 μm can be obtained by recrystallisation. Carrying out the last intermediate annealing of the cold-rolled aluminium alloy strip at 300° C. to 500° C. provides a recrystallised microstructure with grain sizes of more than 20 μm for the final cold-rolling step 6. Steps 4 and 5 can be repeated, if need be, in order to obtain thinner final sheet thicknesses where required. Strain hardening is introduced into the recrystallised microstructure through the cold rolling according to step 6 at a degree of rolling of 30% to 60% to a final thickness, which leads to an increase in the yield strength $R_{p0.2}$. The cold-rolled microstructure undergoes a recovery through a reverse annealing according to step 7, so that in particular the uniform elongation $A_g$ and the percentage reduction of area after fracture Z again take on higher values and good forming behaviour is set. The increase in the yield strength $R_{p0.2}$ obtained during the last cold rolling is at least partly maintained due to the choice of temperature after reverse annealing, so that an aluminium alloy strip with a yield strength of more than 190 MPa can be provided. With elongation values for the uniform elongation $A_g$ of more than 14% and values for the percentage reduction of area at fracture Z of more than 50%, the produced aluminium alloy strip and sheets produced from it can also be subjected to complex forming operations.

In the additional step 8 illustrated in FIG. 1, sheets are cut from the aluminium alloy strip which in forming operations are subsequently formed into formed parts, for example into vehicle components of the "Body-in-White" of a motor vehicle, so-called BIW components. BIW components often have complex geometries and therefore require a high formability of the strips or sheets from which they are produced. In order to achieve significant weight reductions, BIW components consisting of an aluminium alloy also require correspondingly narrow sheet thicknesses which calls for high strengths and yield strengths of the aluminium alloy strips or sheets used. The aluminium alloy strips according to the invention and the sheets produced from them meet this requirement as well as the required corrosion resistance, as tests show. Therefore, if vehicle components, in particular BIW components, are produced from an aluminium alloy strip according to the invention, they can be provided more cost-effectively than previous components consisting of AA6XXX materials.

Figure 2A:
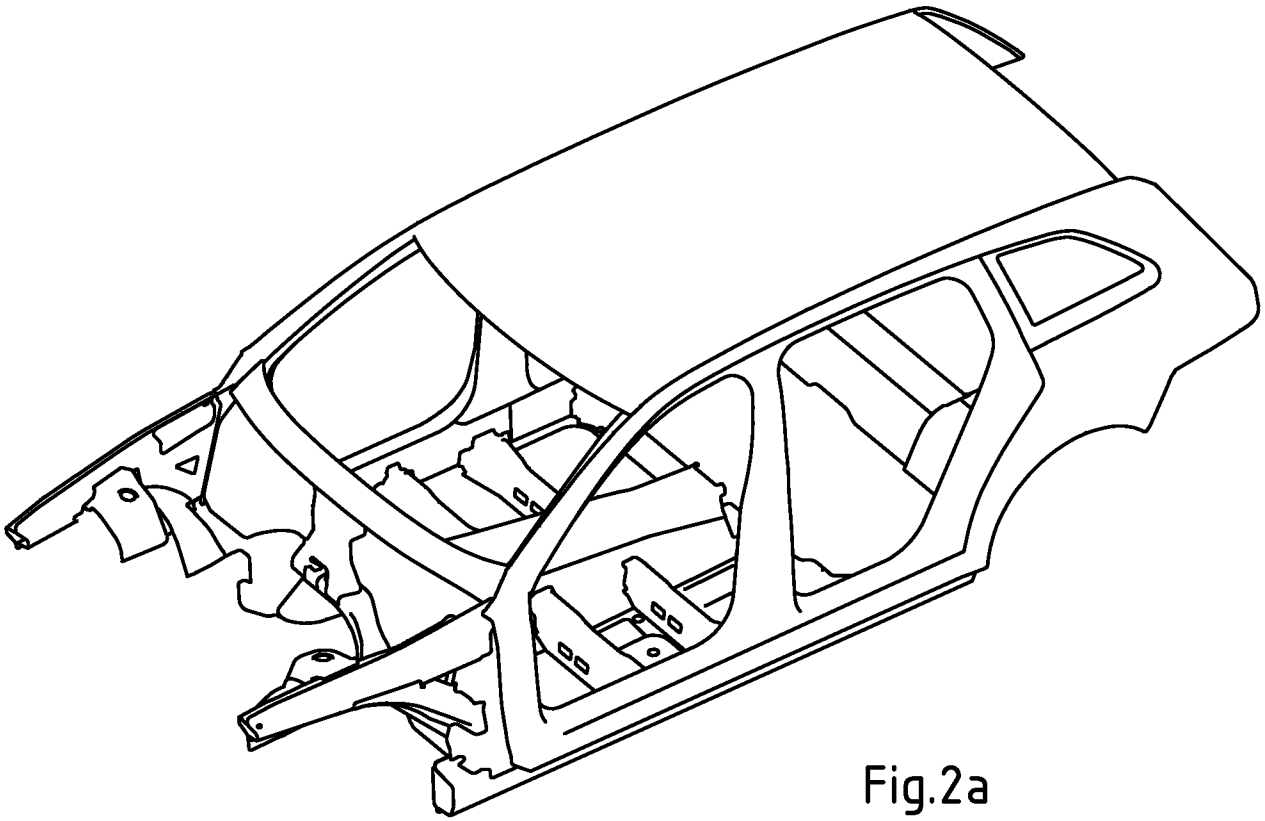
FIGS. 2*a*) and *b*) show a schematic, perspective illustration the exemplary embodiments of an advantageous use of the aluminium alloy strip.
Figure 2B:
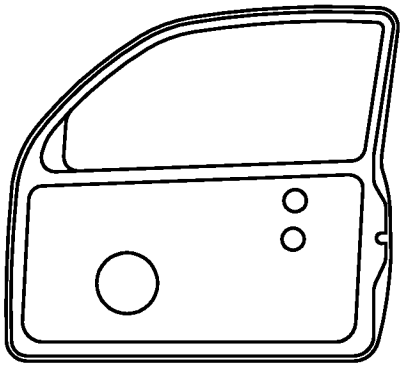

FIGS. 2*a*) and 2*b*) schematically show application areas of the aluminium alloy strip produced according to the invention in the form of various sheets of a vehicle structure according to FIG. 2*a* or, for example, a schematically illustrated inner part of a vehicle door according to FIG. 2*b*). Further application possibilities for the non-precipitation-hardenable, i.e. naturally hard aluminium alloy strips and sheets according to the invention in the motor vehicle are made available as a result of the good corrosion behaviour of the aluminium alloy strips according to the present invention.

Rolling ingots were cast from different aluminium alloy compositions, were subjected to homogenisation at 480° C. to 550° C. for at least 0.5 h, were hot rolled into hot strips at 280° C. to 500° C. and were subsequently subjected to varying conditions during cold rolling before and after a last intermediate annealing. Table 1 shows seven different alloy compositions in total. In the twelve tests, in addition to the seven different alloys different parameters were used for the cold rolling before and after the last intermediate annealing. Up to the completion of the hot strips, the test strips produced did not differ, except for different hot strip thicknesses and different aluminium alloys.

TABLE 1

| Test No | | Alloying constituents [wt %] | | | | | | | |
|---|---|---|---|---|---|---|---|---|---|
| | | Si | Fe | Cu | Mg | Mn | Cr | Zn | Ti |
| 1 | Cmp | 0.136 | 0.318 | 0.031 | 2.9 | 0.80 | 0.068 | 0.011 | 0.013 |
| 2 | Cmp | 0.210 | 0.320 | 0.028 | 4.1 | 0.41 | 0.120 | 0.007 | 0.011 |
| 3 | Cmp | 0.031 | 0.130 | 0.002 | 4.2 | 0.25 | 0.001 | 0.004 | 0.021 |
| 4 | Inv | 0.031 | 0.130 | 0.002 | 4.2 | 0.25 | 0.001 | 0.004 | 0.021 |
| 5 | Inv | 0.031 | 0.130 | 0.002 | 4.2 | 0.25 | 0.001 | 0.004 | 0.021 |
| 6 | Cmp | 0.031 | 0.130 | 0.002 | 4.2 | 0.25 | 0.001 | 0.004 | 0.021 |
| 7 | Inv | 0.073 | 0.190 | 0.004 | 4.4 | 0.29 | 0.004 | 0.005 | 0.015 |
| 8 | Inv | 0.031 | 0.130 | 0.002 | 4.2 | 0.25 | 0.001 | 0.004 | 0.021 |
| 9 | Cmp | 0.140 | 0.290 | 0.060 | 4.7 | 0.58 | 0.090 | 0.009 | 0.019 |
| 10 | Inv | 0.050 | 0.170 | 0.023 | 4.9 | 0.26 | 0.008 | 0.003 | 0.026 |
| 11 | Inv | 0.062 | 0.190 | 0.120 | 5.2 | 0.25 | 0.005 | 0.004 | 0.013 |
| 12 | Inv | 0.062 | 0.190 | 0.120 | 5.2 | 0.25 | 0.005 | 0.004 | 0.013 |

In Table 1, other impurities, which were less than 0.01 wt %, are not specified in the exemplary embodiments. The remaining content consisted of aluminium.

In addition, in Table 1 the alloying constituents which lie outside the range provided according to the invention are underlined. Tests 1, 2 and 9 comprised aluminium alloys whose Mg, Mn or Cr contents lie outside the range according to the invention. In comparison example No. 1, the Mg content is too low and the contents of Mn and Cr too high. Comparison example No. 2 also comprises too high values for Cr and slightly increased values for Mn. Comparison example No. 9 again has values for Mn and Cr which are significantly too high.

The hot strips provided from different aluminium alloys were then according to the specifications in Table 2 cold rolled in the cold rolling before the last intermediate annealing and after the intermediate annealing. The reverse annealing temperature was 240° C. in all tests. The reverse annealing took place in the coil, wherein the metal temperature of the reverse annealing temperature was maintained for a period of at least 0.5 h. In Table 2, the final thicknesses $a_0$, which lie approximately between 0.7 mm and 1.7 mm, are also specified.

In Table 2, the degrees of rolling which lie outside the range according to the invention are underlined. Comparison example Nos 1 and 6 have degrees of rolling which are too high before the intermediate annealing, whereas comparison example No. 3 has a final degree of rolling after the intermediate annealing which is too low.

In all tests, after the intermediate annealing the average grain size, i.e. the average grain diameter, was measured. For this purpose, samples of the strips were taken and longitudinal sections were anodised according to the Barker Method. The samples were measured under the microscope according to ASTM E1382 and the average grain size determined by the average grain diameter.

After the strips had been produced, samples were taken and mechanical properties, such as the yield strength $R_{p0.2}$, the tensile strength $R_m$, the uniform elongation $A_g$, the elongation at break $A_{80\ mm}$ and the percentage reduction of area after fracture Z, were measured according to EN 10002-1 or ISO 6892, respectively. All values are recorded in Table 3 in addition to the determined average grain sizes or the average grain diameters, respectively. Table 3 additionally also shows the values of mass loss in a corrosion test according to ASTM G67 (NAMLT), in which the samples were previously subjected to simulated thermal stress for 17 h at 130° C.

TABLE 2

| Test No. | Type | Rolling degree before last intermediate annealing [%] | Final rolling degree [%] | Reverse annealing temperature [° C.] | Final thickness $a_0$ [mm] |
|---|---|---|---|---|---|
| 1 | Cmp | 58 | 40 | 240 | 1.488 |
| 2 | Cmp | 25 | 50 | 240 | 1.700 |
| 3 | Cmp | 25 | 20 | 240 | 1.480 |
| 4 | Inv | 24 | 31 | 240 | 1.324 |
| 5 | Inv | 24 | 40 | 240 | 1.482 |
| 6 | Cmp | 61 | 40 | 240 | 1.489 |
| 7 | Inv | 25 | 50 | 240 | 1.231 |
| 8 | Inv | 24 | 60 | 240 | 0.773 |
| 9 | Cmp | 25 | 50 | 240 | 1.337 |
| 10 | Inv | 43 | 60 | 240 | 1.398 |
| 11 | Inv | 26 | 50 | 240 | 1.502 |
| 12 | Inv | 26 | 60 | 240 | 1.211 |

The mechanical properties which lie outside the values claimed for the aluminium alloy strip according to the invention are again underlined.

TABLE 3

| Test No | Type | $R_{p0.2}$ [MPa] | $R_m$ [MPa] | $A_g$ [%] | $A_{80mm}$ [%] | Z [%] | IC (17 h/ 130° C.) [mg/ $cm^2$] | Grain size after intermediate annealing [μm] |
|---|---|---|---|---|---|---|---|---|
| 1 | Cmp | 227 | 297 | 10.6 | 11.5 | 49 | 1.1 | 10 |
| 2 | Cmp | 244 | 331 | 14.6 | 16.1 | 45 | 4.1 | 15 |
| 3 | Cmp | 159 | 266 | 18.8 | 23.8 | 71 | 8.6 | 29 |
| 4 | Inv | 191 | 291 | 15.1 | 18.1 | 59 | 6.8 | 31 |
| 5 | Inv | 201 | 298 | 15.0 | 18.0 | 58 | 6.6 | 31 |
| 6 | Cmp | 210 | 304 | 15.7 | 18.6 | 52 | 18.6 | 13 |
| 7 | Inv | 217 | 311 | 15.5 | 18.2 | 62 | 2.5 | 33 |
| 8 | Inv | 211 | 307 | 16.2 | 18.4 | 56 | 5.8 | 31 |
| 9 | Cmp | 257 | 349 | 12.8 | 14.3 | 39 | 4.2 | 13 |
| 10 | Inv | 238 | 342 | 16.6 | 19.2 | 56 | 12.6 | 21 |
| 11 | Inv | 258 | 353 | 15.3 | 16.5 | 53 | 6.3 | 27 |
| 12 | Inv | 270 | 359 | 15.6 | 17.8 | 55 | 5.6 | 27 |

The comparison examples 1 and 2 clearly show the effect of the alloy composition on the results with regard to the formability. In comparison example No. 1, which has a significantly increased Mn content, the uniform elongation $A_g$, for example, drops to 10.6%. The insufficient Mg content in comparison example No. 1 also acts against large elongation values.

Comparison example No. 2 having an increased Cr content with a slightly excessive Mn content shows, on the other hand, percentage reduction of area after fracture values Z which are under 50%, indicating a worsened forming behaviour. The percentage reduction of area after fracture Z namely represents the property of the material to provide in the case of large forming operations material for the forming via a reduction of cross-section without breaking. Due to the higher Mn contents or Cr contents, the average grain size of 10 or 15 μm has no negative effect on the corrosion properties of these samples.

If comparison example No. 3 is compared to exemplary embodiment No. 4 according to the invention, it becomes clear that the yield strength $R_{p0.2}$ can be set by setting the degree of rolling during final rolling after the intermediate annealing. Exemplary embodiments Nos 4, 5 and 8 show that via final degrees of rolling after the intermediate annealing of 31% to 60% the yield strength $R_{p0.2}$ can be raised to values up to 211 MPa without entailing significant losses in the range of the characteristic values important for the forming, such as the uniform elongation $A_g$ or Z.

If comparison example No. 6 is included, which has an identical aluminium alloy to the examples 3, 4, 5 and 8, the effect of setting the average grain diameter by limiting the degree of rolling during cold rolling before the last intermediate annealing can be very clearly identified. At a degree of rolling of 61% during cold rolling before the last intermediate annealing, a relatively fine grain with an average diameter or an average grain size of 13 μm is produced by the intermediate annealing, which negatively effects the corrosion properties. Comparison example No. 6 is rated as not resistant to intercrystalline corrosion.

The exemplary embodiments according to the invention show that the yield strength $R_{p0.2}$ can be increased to values up to 270 MPa by using degrees of rolling during final cold rolling of 40% to 60%. Here, in particular the higher Mg content of up to 5.2 wt % in exemplary embodiment No. 12 contributes to the marked increase in the yield strength $R_{p0.2}$.

A comparison of the exemplary embodiments Nos 9, 10 and 11 according to the invention shows that the corrosion resistance significantly depends on the choice of the degree of rolling before the last intermediate annealing and hence on the average grain diameter or the average grain size. In the case of exemplary embodiments Nos 10 and 11, the Mg content is increased compared to exemplary embodiment 9, which in principle could result in worse corrosion resistance with respect to intercrystalline corrosion. Surprisingly, however, the corrosion resistance of these exemplary embodiments is significantly better compared to exemplary embodiment No. 9 having a smaller grain diameter and a lower Mg content. Here, it becomes clear that the preferred procedural path via the restrictions according to the invention on the degrees of cold rolling before the last intermediate annealing has a marked effect on the end product of the reverse annealed strip.

In conclusion, the exemplary embodiments according to the invention show that an aluminium alloy strip can be provided which has yield strength values, elongation values and a corrosion resistance to intercrystalline corrosion, which is particularly well suited for use in highly stressed vehicle components and which due to the use of a non-precipitation-hardenable aluminium alloy can be produced in a cost-effective way.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method for producing an aluminium strip or sheet from an aluminium alloy having the following alloying constituents in wt %:

3.6%≤Mg≤6%,
Si≤0.4%,
Fe≤0.5%,
Cu≤0.15%,
0.1%≤Mn≤0.4%,
Cr≤0.05%,
Zn≤0.20%,
Ti≤0.20%, with the remainder Al and unavoidable impurities, individually at most 0.05 wt %, in total at most 0.15 wt %, wherein the method comprises the following steps:

casting a rolling ingot consisting of the specified aluminium alloy, homogenising the rolling ingot at 480° C. to 550° C. for at least 0.5 h, hot rolling the rolling ingot at a temperature of 280° C. to 500° C. into a hot strip, cold rolling the aluminium alloy strip after hot rolling with a degree of rolling of 20% to 30% before a last intermediate annealing, carrying out at least a last intermediate annealing on the cold-rolled aluminium alloy strip at 300° C. to 500° C. in such a way that the cold-rolled aluminium alloy strip has a recrystallised microstructure after the intermediate annealing, cold rolling the intermediate-annealed aluminium alloy strip with a degree of rolling of 40% to 60% to a final thickness and reverse annealing the aluminium alloy strip in a coil at the final thickness, wherein the metal temperature is 220-240° C. for at least 0.5 h.

2. The method according to claim 1, wherein the aluminium alloy strip is cold rolled to a final thickness of 0.5 mm to 5.0 mm.

3. The method according to claim 1, wherein the aluminium alloy strip is cold rolled to a final thickness of 1.0 mm to 3.0 mm.

4. A cold-rolled and reverse annealed aluminium alloy strip or sheet, produced using a method according to claim 1, consisting of an aluminium alloy having the following alloying constituents:

3.6%≤Mg≤6%,
Si≤0.4%,
Fe≤0.5%,
Cu≤0.15%,
0.1%≤Mn≤0.4%,
Cr≤0.05%,
Zn≤0.20%,
Ti≤0.20%,
with the remainder Al and unavoidable impurities, individually at most 0.05 wt %, in total at most 0.15 wt %,
wherein the aluminium alloy strip has
a yield strength $R_{p0.2}$ of more than 190 MPa,
a uniform elongation $A_g$ of at least 14%,
a percentage reduction of area after fracture Z of more than 50% and
in the corrosion test according to ASTM G67, after a prior sensitization heat treatment for 17 h at 130° C., a mass loss of less than 15 mg/cm$^2$.

5. The aluminium alloy strip or sheet according to claim 4, wherein the Mg content of the aluminium alloy strip is 4.2 wt % to 6 wt %.

6. The aluminium alloy strip or sheet according to claim 4, wherein the Mn content of the aluminium alloy strip is 0.1 wt % to 0.3 wt %.

7. The aluminium alloy strip or sheet according to claim 4, wherein the Cr content of the aluminium alloy strip is less than 0.01 wt %.

8. The aluminium alloy strip or sheet according to claim 4, wherein the aluminium alloy strip has one or more of the following restrictions on the proportions of the alloying constituents in wt %:

Si≤0.2%,
Fe≤0.35% or
Zn≤0.01%.

9. The aluminium alloy strip or sheet according to claim 4, wherein the aluminium alloy strip has one or more of the following properties:

a yield strength $R_{p0.2}$ of more than 200 MPa,
a uniform elongation $A_g$ of at least 15%,
a percentage reduction of area after fracture Z of at least 55% or
in the corrosion test according to ASTM G67, after a prior sensitization heat treatment for 17 h at 130° C., a mass loss of less than 10 mg/cm$^2$.

10. The aluminium alloy strip or sheet according to claim 4, wherein the aluminium alloy strip has a thickness of 0.5 mm to 5.0 mm.

11. An aluminium alloy strip or sheet according to claim 4 for producing structural parts or chassis components of a motor vehicle.

12. The aluminium alloy strip or sheet according to claim 4, wherein the Mg content of the aluminium alloy strip is 4.2 wt % to 5.2 wt %.

13. The aluminium alloy strip or sheet according to claim 4, wherein the aluminium alloy strip has a thickness of 1.0 mm to 3.0 mm.

14. A method for producing an aluminium strip or sheet from an aluminium alloy having the following alloying constituents in wt %:

3.6%≤Mg≤6%,
Si≤0.4%,
Fe≤0.5%,
Cu≤0.15%,
0.1%≤Mn≤0.4%,
Cr≤0.05%,
Zn≤0.20%,
Ti≤0.20%,
with the remainder Al and unavoidable impurities, individually at most 0.05 wt %, in total at most 0.15 wt %,
wherein the method comprises the following steps:
casting a rolling ingot consisting of the specified aluminium alloy,
homogenising the rolling ingot at 480° C. to 550° C. for at least 0.5 h,
hot rolling the rolling ingot at a temperature of 280° C. to 500° C. into a hot strip,
cold rolling the aluminium alloy strip after hot rolling with a degree of rolling of 20% to 26% before a last intermediate annealing,
carrying out at least a last intermediate annealing on the cold-rolled aluminium alloy strip at 300° C. to 500° C. in such a way that the cold-rolled aluminium alloy strip has a recrystallised microstructure after the intermediate annealing,
cold rolling the intermediate-annealed aluminium alloy strip with a degree of rolling of 50% to 60% to a final thickness and
reverse annealing the aluminium alloy strip in a coil at the final thickness, wherein the metal temperature is 220-240° C. for at least 0.5 h.

* * * * *